United States Patent [19]

Swindler

[11] Patent Number: 4,500,217

[45] Date of Patent: Feb. 19, 1985

[54] ELECTRONIC PRINTER MECHANISM WITH MOVABLE PRINTHEAD ASSEMBLY

[75] Inventor: Danny E. Swindler, Lubbock, Tex.

[73] Assignee: Texas Instruments Incorporated, Dallas, Tex.

[21] Appl. No.: 441,313

[22] Filed: Nov. 12, 1982

[51] Int. Cl.[3] ..... B41J 19/30; B41J 25/30; B41J 29/02

[52] U.S. Cl. ..... 400/320; 400/322; 400/328; 400/314; 400/617; 400/693

[58] Field of Search ..... 400/120, 320, 322, 328, 400/314, 691–693, 694, 569, 617, 636; 74/436

[56] References Cited

U.S. PATENT DOCUMENTS

| | | | |
|---|---|---|---|
| 2,607,236 | 8/1952 | Heidegger | 74/436 |
| 3,048,253 | 8/1962 | Oldenburg et al. | 400/569 X |
| 3,280,730 | 10/1966 | Churchill | 400/614 X |
| 3,814,230 | 6/1974 | Okabe | 400/120 X |
| 3,840,107 | 10/1974 | Mack et al. | 400/636 X |
| 3,929,215 | 12/1975 | Hayakawa | 400/120 X |
| 4,050,569 | 9/1977 | Crump et al. | 400/320 X |
| 4,257,282 | 3/1981 | Wilczewski et al. | 400/320 X |
| 4,379,646 | 4/1983 | Maeda | 400/120 X |
| 4,401,391 | 8/1983 | Kawai et al. | 400/120 |

*Primary Examiner*—Paul T. Sewell

*Attorney, Agent, or Firm*—William E. Hiller; James T. Comfort; Melvin Sharp

[57] ABSTRACT

An electronic printer mechanism having a movable printhead assembly , wherein the printhead is a matrix of selectively heatable semiconductor mesas for producing dot matrix characters one line at a time on a paper medium. The electronic printer mechanism is constructed with a sectional housing including upper and lower housing sections which are releasably secured together to define an interior chamber for receiving components of the electronic printer. The lower housing section is provided with complementary sets of shaft-receiving recesses such that drop-in assembly of components with respect to the lower housing section as received in respective sets of the recesses prior to securement of the upper and lower housing sections together is accomplished. One component assembly comprises an operating shaft on which the printhead assembly including a carrier member fixedly supporting a printhead is mounted for transversing movement therealong. A gear train assembly driven by a rotary power shaft from a motor imparts rotation to the operating shaft and includes a timing control gear for sequentially stepping through the operating cycle of the printer and a paper-advancing gear arrangement. The paper-advancing gear arrangement relies upon a Geneva gear wheel to intermittently advance the paper one line for each periodic rotation of the Geneva gear wheel as the carrier member and printhead supported thereby complete a one line traverse along the rotating operating shaft.

2 Claims, 13 Drawing Figures

ELECTRONIC PRINTER MECHANISM WITH MOVABLE PRINTHEAD ASSEMBLY

BACKGROUND OF THE INVENTION

This invention generally relates to a printer mechanism for producing indicia on a web medium including alphanumeric characters and symbols by suitable means, such as dot matrix characters. More particularly, the printer mechanism is an electronic type having a printhead assembly comprising a thermal printhead supported by a carrier member for traversing movement along a rotating operating shaft in printing a line of characters. The printhead assembly is then returned to its original starting position with the web medium being advanced one line to repeat the traversing movement of the carrier member and the printhead supported thereby in printing a subsequent line of characters. In one specific aspect, the electronic printer mechanism may comprise a peripheral printer component for use with a calculator or other data-processing unit so as to provide a printing capability therefor.

Heretofore, electronic printer mechanisms employed as printer peripherals for use with data-processing devices, such as calculators and computers, for example, have been characterized by the presence of many mechanical parts subject to maintenance and repair at frequent intervals. In addition, the presence of so many parts accompanied by space limitations within the housing of the printer mechanism have contributed to a tedious and time-consuming effort when the internal printer assembly must be disassembled for repair and/or replacement of parts.

Another area of difficulty experienced with electronic printer mechanisms lies in the mechanical structure employed to advance the paper upon completion of the printing of a line of characters so that subsequent lines of characters may be printed in an orderly manner. Mechanical paper-advancing mechanisms included in electronic printers, especially those which are subject to high speed requirements, are prone to jamming, either because of the limited tolerances built thereinto with respect to alignment of the paper and precise one-line advancement at a time or because of careless handling by operators in initially positioning the paper or in removing same from the printer mechanism.

Typical of the type of electronic printer mechanisms with which the present invention is concerned is the electronic printer disclosed in U.S. Pat. No. 3,874,493 Boyd issued Apr. 1, 1975 in which a thermal printhead is supported on a carriage member for traversing movement along a pair of guide rods to enable the thermal printhead by selective actuation of the semiconductor mesas thereof to produce a line of printed characters upon paper. The paper is interposed between the printhead and a pressure pad supported by a pressure pad carriage moving along a track in unison with the thermal printhead. U.S. Pat. No. 3,874,493 Boyd is hereby incorporated by reference.

SUMMARY OF THE INVENTION

In accordance with the present invention, an improved electronic printer mechanism is provided in which the number of mechanical parts has been materially reduced in comparison to known electronic printer mechanisms of comparable type and ability. Further adding to the comparative simplicity of the present electronic printer mechanism is the housing structure therefor which is of sectional character including an upper and a lower housing section, with the lower housing section being so structured as to accommodate a simple drop-in assembly of components prior to its releasable securement to the upper housing section. To this end, the lower housing section is equipped with sets of shaft-receiving recesses provided in sidewalls thereof for accepting a plurality of shafts extending thereacross and providing bearing surfaces therefor, the shafts having respective component assemblies mounted thereon. This drop-in assembly capability facilitates maintenance and/or part replacement of the components of the electronic printer mechanism by allowing quick disassembly and reassembly of the components from the lower housing section when the upper housing section has been released from securement therewith.

In another aspect, the electronic printer mechanism is equipped with a web-advancing assembly for advancing the web medium, such as paper, on which respective characters are printed in a linear arrangement, the web-advancing assembly being sequentially operable in response to the completion of one line of printing to advance the paper one line for printing of a subsequent line of characters thereon. The web-advancing assembly is part of a gear train means which effects rotary movement of an operating shaft from the rotation of a power shaft of an electric motor. In this connection, a printhead assembly comprising a carrier member supporting a printhead is mounted on the operating shaft for traversing movement therealong in response to the rotation of the operating shaft imparted thereto via the gear train means from the power shaft of the electric motor. The gear train includes a control gear wheel having one side surface thereof provided with a cam crank arrangement. The web-advancing assembly further includes a web-advancing shaft having a Geneva gear wheel fixedly mounted thereon and disposed in opposition to the surface of the control gear wheel having the cam crank arrangement thereon. The Geneva gear wheel is periodically rotated in response to the rotation of the control gear wheel by camming engagement between the cam crank arrangement and the Geneva gear wheel in a manner intermittently rotating the web-advancing shaft in a direction advancing the web medium or paper one line for each periodic rotation of the Geneva gear wheel.

In yet another aspect of the invention, the operating shaft of the electronic mechanism on which the carrier member supporting the printhead is mounted for traversing movement therealong as the operating shaft is rotating has a continuous helical groove running lengthwise thereof and reversing back to its origin for accepting a follower detent depending from the carrier member on which the printhead is supported. Thus, as the operating shaft rotates, the follower detent tracks along the helical groove provided in the operating shaft causing traversing movement of the carrier member in an axial direction along the length of the operating shaft in both forward and reverse directions.

BRIEF DESCRIPTION OF THE DRAWINGS

By way of example, and in order to describe various aspects of the invention in greater detail, together with the advantages thereof, reference is made to the drawings, wherein.

DETAILED DESCRIPTION

Figure 1:
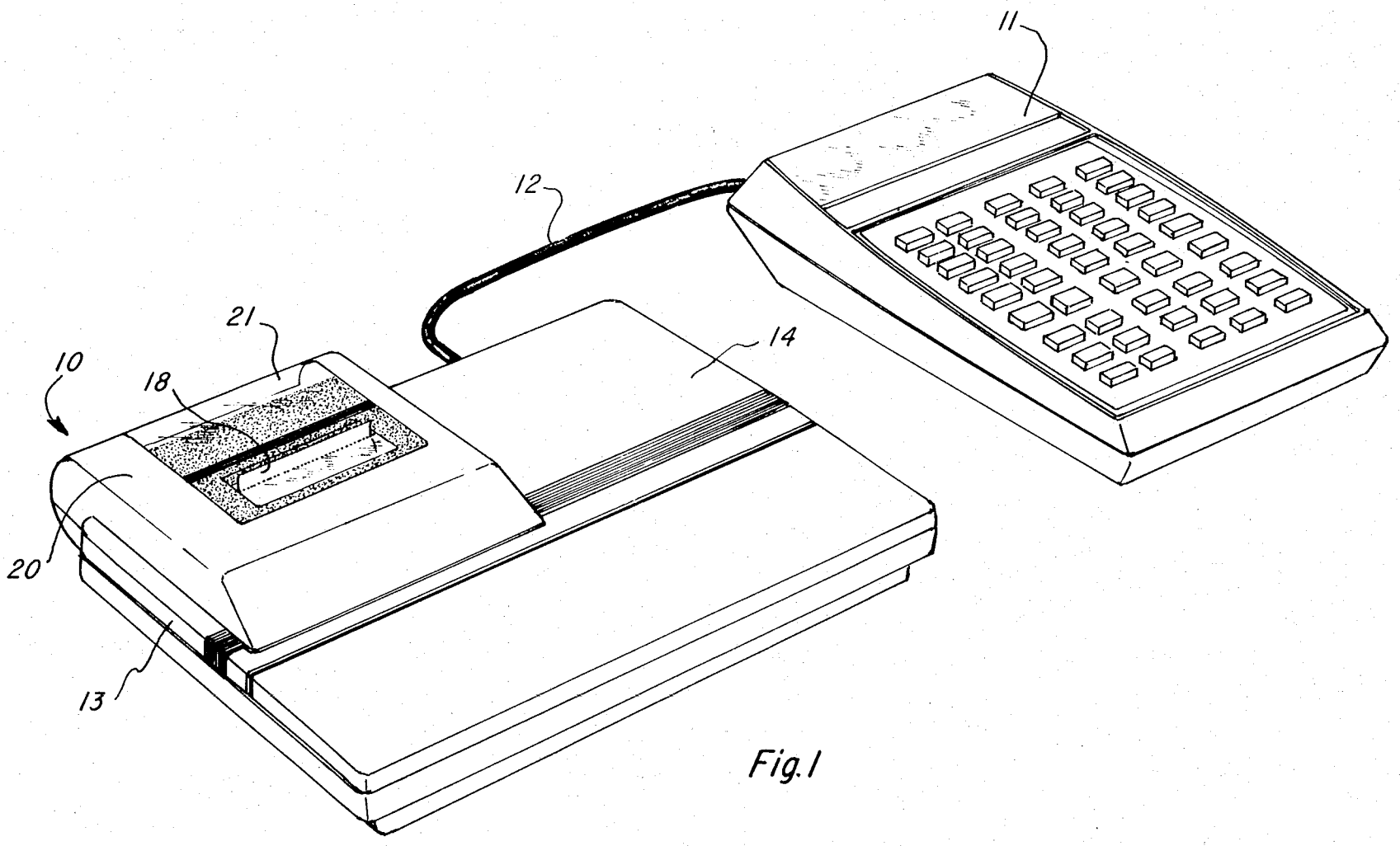
FIG. 1 is a perspective view showing the electronic printer mechanism of the present invention as a printer peripheral electrically connected to a data-processing machine, such as a calculator.
Figure 2:
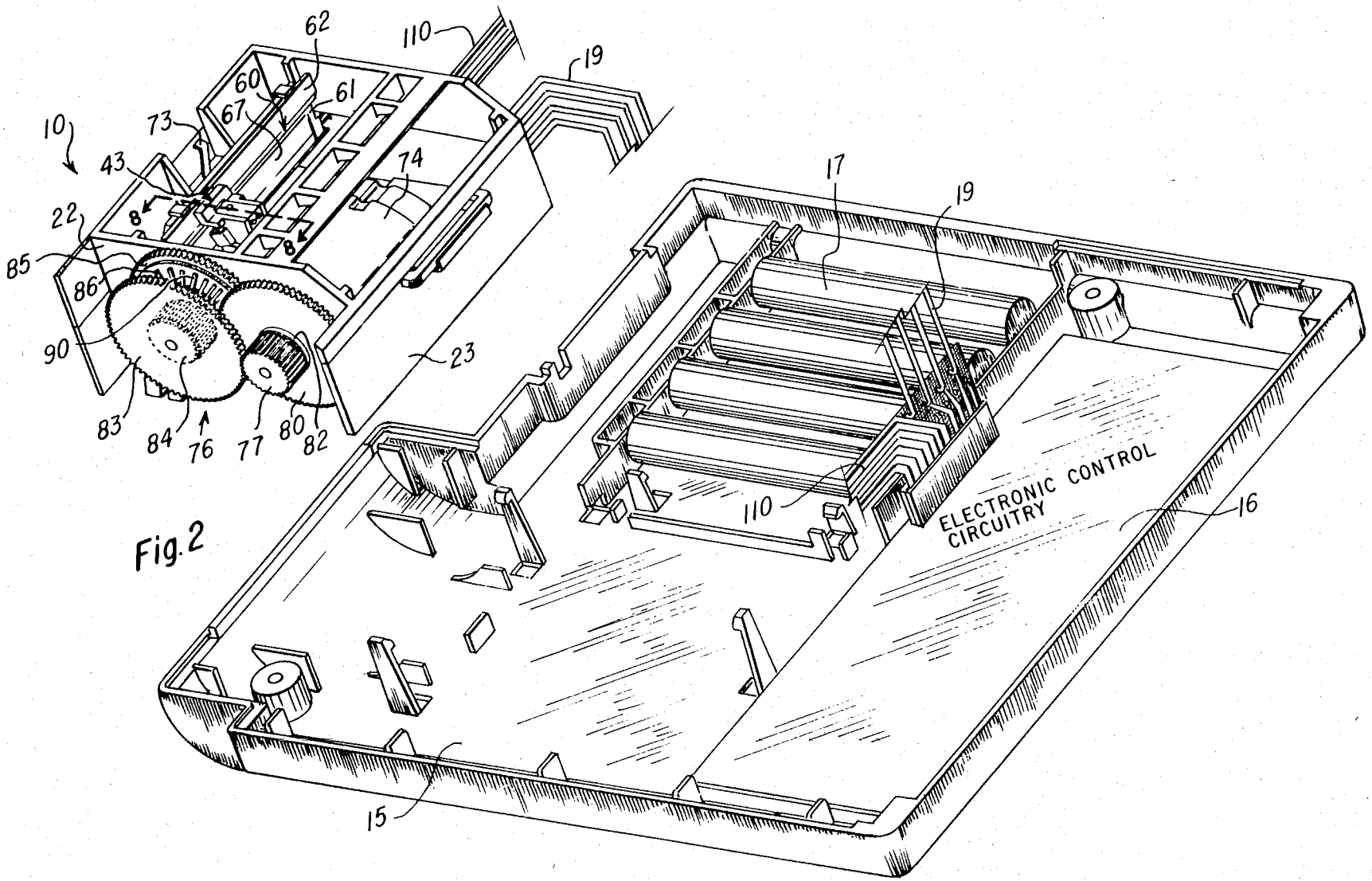
FIG. 2 is a partial exploded perspective view of the electronic printer mechanism shown in FIG. 1, including the bottom section of an overall printer casing and the electronic printer mechanism as contained therein.

Referring more specifically to the drawings, FIG. 1 illustrates the electronic printer mechanism as constructed in accordance with this invention in a specific application as printer peripheral equipment for electrical connection to a data-processing unit to provide printing capability therefor. To this end, the electronic printer mechanism 10 is shown in FIG. 1 as being electrically connected to a data-processing unit 11, such as an electronic calculator, via an input/output connection 12 extending therebetween and provided with a suitable plug for reception within a socket in the housing of the data-processing unit 11. It will be understood that the data-processing unit 11 may be electronic equipment other than a calculator, such as the central processing unit of a general purpose computer, for example, where printing capability is desired. The electronic printer mechanism 10, as shown in FIG. 1, generally comprises a casing 13 which includes upper and lower basic casing sections, the upper casing section 14 appearing in FIG. 1 and cooperating with the lower basic casing section to provide respective compartments within the casing 13 for containing electronic control circuitry and a power source. To this end, the lower basic casing section 15 is illustrated in FIG. 2, showing the electronic control circuitry 16 for regulating the electronic printer mechanism through its operating cycle, as will be generally described hereinafter. The power source 17 as mounted within the compartment therefor in the lower basic casing section 15 may take the form of one or more dry cell batteries for providing electrical energy to operate the electronic printer mechanism 10. Appropriate electrical connectors 19 interconnect the electronic control circuitry 16 with an electric motor to be subsequently described. The electronic printer mechanism 10 is housed within a raised casing portion 20 separately disengagable from the upper basic casing section 14 to expose the electronic printer mechanism 10 therewithin. The raised casing portion 20 extends upwardly with respect to the surface of the upper basic casing section 14 and is provided with an elevated top surface having a transparent panel 21 through which the printhead assembly of the electronic printer mechanism and the web medium upon which printed indicia in the form of alphanumeric characters and symbols are to be printed are observable. The transparent panel 21 is provided with a transverse slot 18 having a serrated edge through which the web medium extends so that respective portions of the web medium having printed indicia thereon may be readily detached by tearing the web medium along the serrated edge of the slot 18. While the electronic printer mechanism 10 is shown in FIGS. 1 and 2 and described as being specifically applicable as a printer peripheral for a data-processing unit, such as the calculator 11, it should be understood that the electronic printer mechanism may exist as an independent stand-alone printer whose source of electronic data from which printed characters are to be derived may be obtained in any suitable manner, such as via an alphanumeric keyboard, for example.

Figure 3:
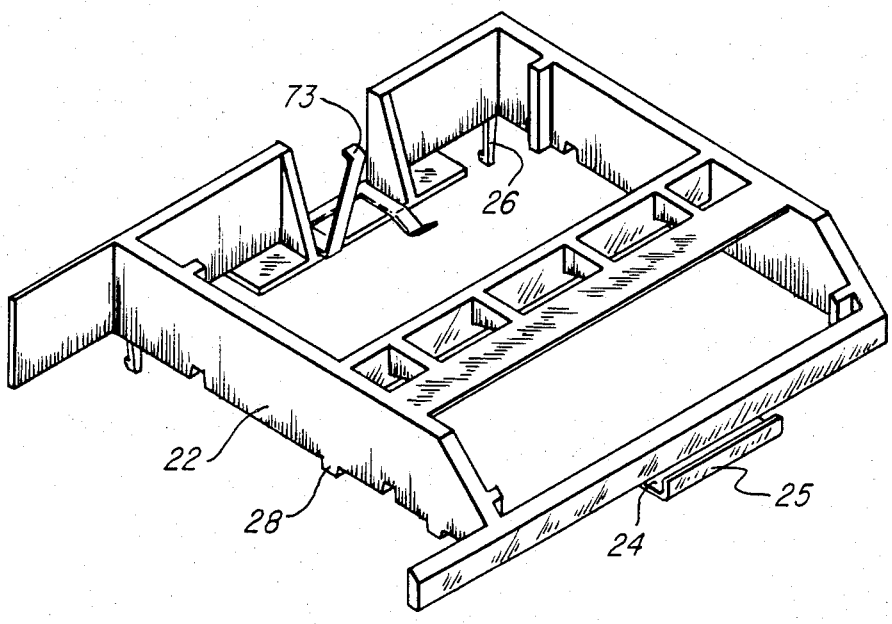
FIG. 3 is an enlarged partially exploded perspective view showing the electronic printer mechanism of FIG. 2 with its sectional housing such that the upper housing section is disengaged from securement to the lower housing section.
Figure 3:
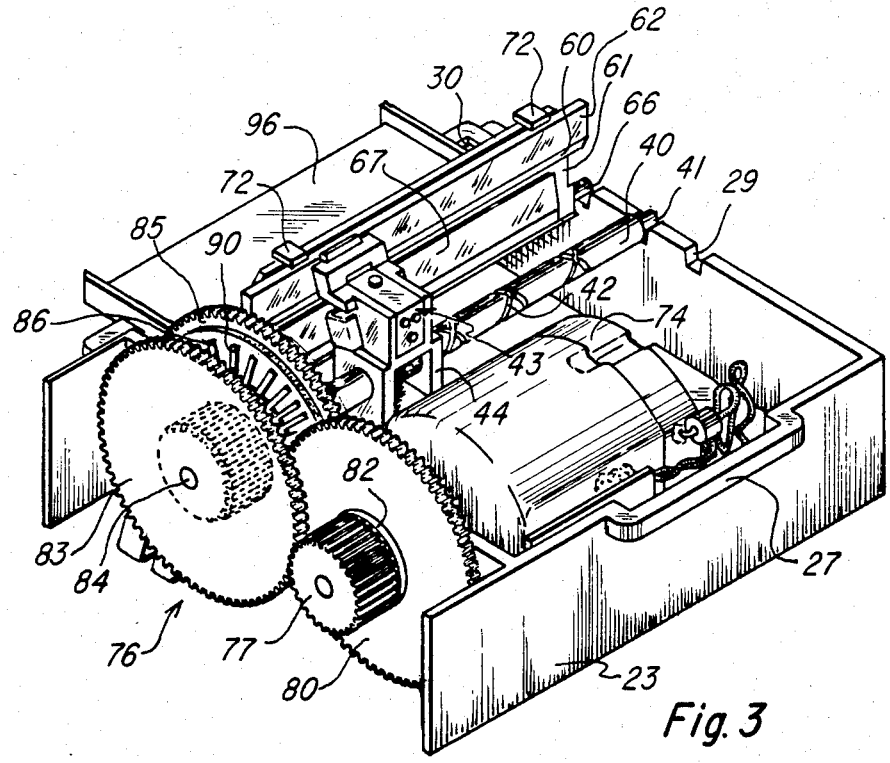
Figure 4:
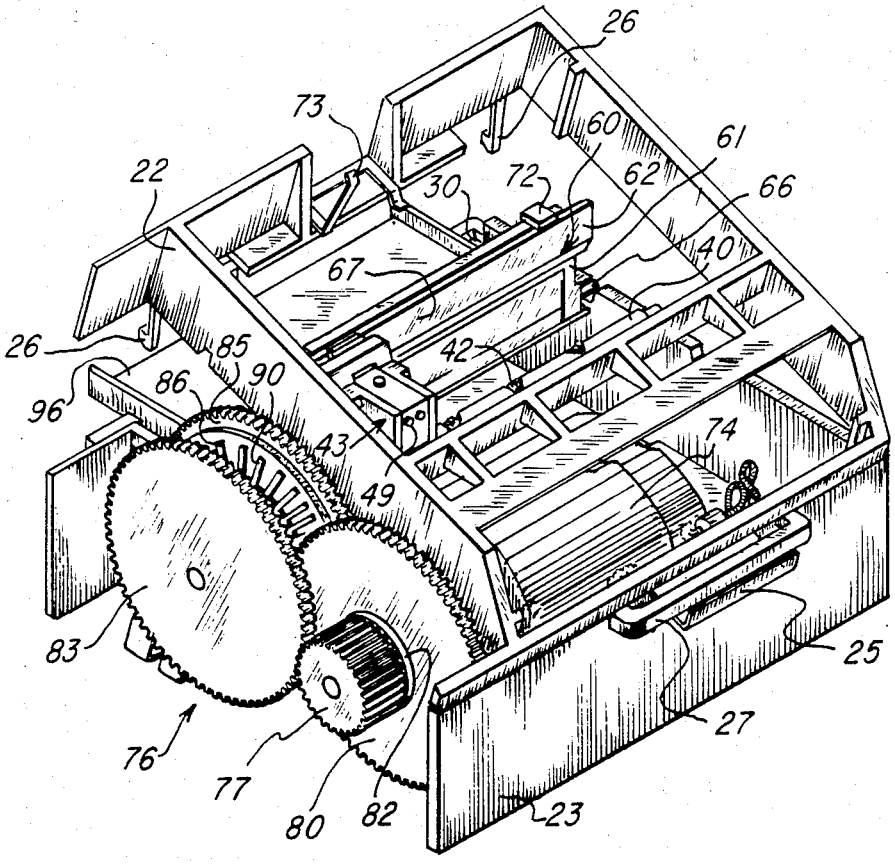
FIG. 4 is an enlarged perspective view of the electronic printer mechanism similar to FIG. 3, but showing the upper housing section in partially latched relation to the lower housing section.

Referring now to FIGS. 3 and 4, the electronic printer mechanism 10 in accordance with the present invention comprises a sectional housing including upper and lower housing sections 22, 23. The upper and lower housing sections 22, 23 are structured in a manner facilitating maintenance and repair of the components of the electronic printer mechanism as disposed within the sectional housing. To this end, means are provided to releasably secure the upper and lower housing sections 22, 23 in mating relationship in defining an interior chamber for receiving the components of the electronic printer mechanism. In the specific illustrated embodiment, the upper housing section 22 is provided with a flange element 24 extending outwardly from one end thereof and having an upturned lip 25 integral therewith to define a latch member. The upper housing section 22 is further provided with a pair of spaced downwardly extending lug members 26, 26, the lug members 26, 26 being located at the opposite end of the upper housing section 22 respectively adjacent the opposite sidewalls thereof. The lower housing section 23 is provided with an outwardly extending latch receiver element 27 at the end thereof corresponding to the end of the upper housing section 22 on which the latch member defined by the flange element 24 and the upturned lip 25 occurs. The latch receiver element 27 of the lower housing section 23 is offset from the major planar surface of the endwall of the lower housing section 23 to define a latch-receiving recess or opening. The lower housing section 23 is also provided with appropriate slots 30, 30 located at the end thereof corresponding to the end of the upper housing section 22 from which the lug members 26, 26 depend, the slots 30, 30 being respectively arranged adjacent opposite sidewalls of the lower housing section 23.

Figure 5:
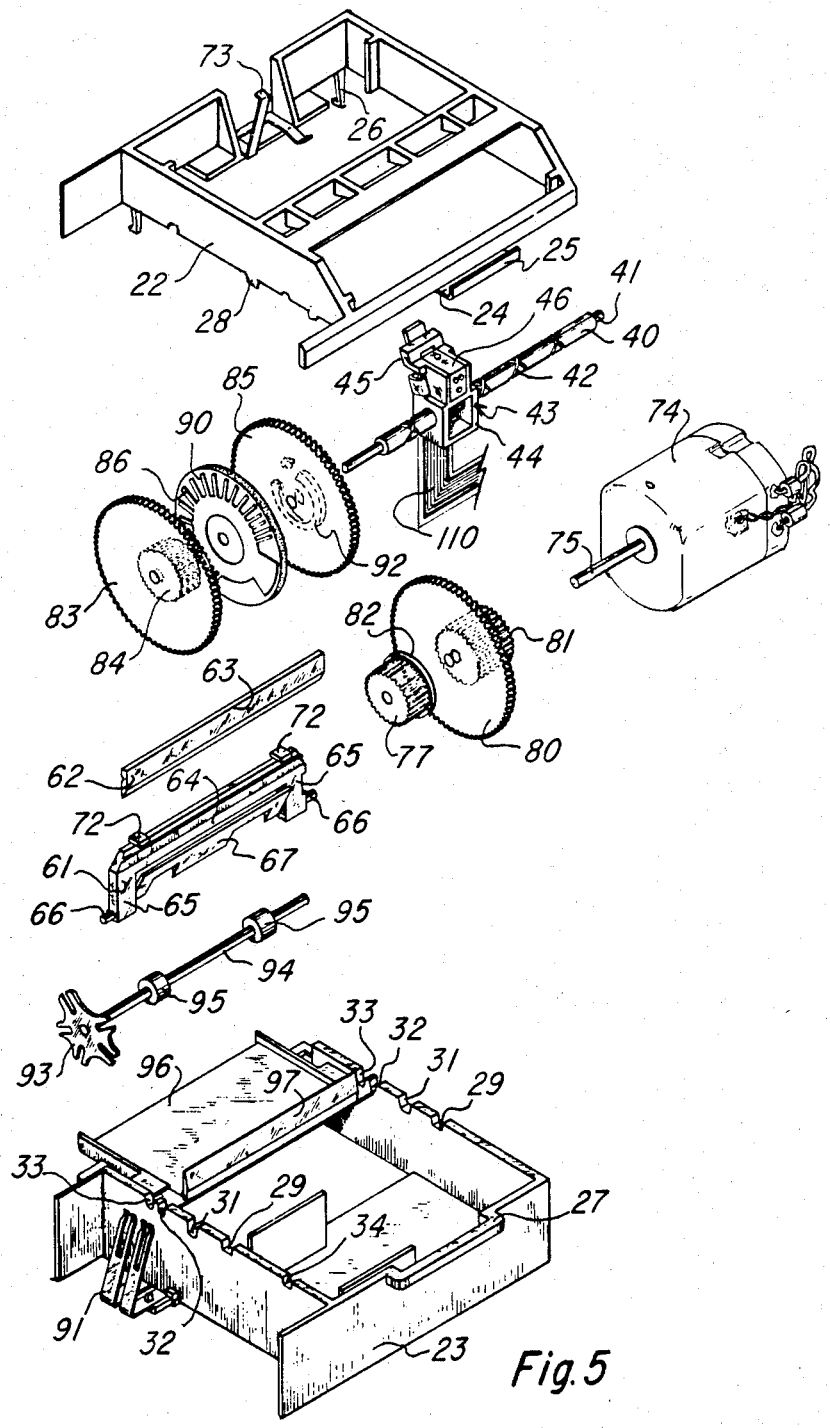
FIG. 5 is an exploded perspective view of components included in the electronic printer mechanism.

Referring to FIGS. 3 and 5, the respective upper and lower housing sections 22, 23 are provided with mating alignment means to maintain the assembled sectional housing with the upper and lower housing sections 22, 23 properly aligned with respect to each other. To this end, the upper housing section 22 is provided with a pair of alignment ribs 28, 28 (FIG. 3) depending from the opposite sidewalls thereof for mating reception within corresponding alignment grooves 29, 29 (FIG. 5) formed in the sidewalls of the lower housing section 23. FIG. 3 shows the upper and lower housing sections 22, 23 of the sectional housing for the electronic printer mechanism 10 as disconnected from each other, whereas FIG. 4 shows the upper and lower housing sections 22, 23 partially connected in releasable securement in that the latch member of the upper housing section 22 defined by the flange element 24 and the up-turned lip 25 is hooked within the recess or opening of the latch receiver element 27 on the lower housing section 23. It will be understood that pivoting movement of the upper housing section 22 in a downward direction with respect to the lower housing section 23 about the pivotal axis provided by the latch member and the latch receiver element thereof respectively will cause the lug members 26, 26 to be received within the slots 30, 30. In this respect, the lug members 26, 26 are sufficiently resilient to snap into releasably locked relation within the slots 30, 30 as the upper housing section 22 is pivoted toward the lower housing section 23 via a camming action of the respective lug members 26, 26 on a slot-defining wall surface of the lower housing section 23. Thus, the upper and lower housing sections 22, 23 are releasably secured together in mating relationship and cooperate to define an interior housing chamber in which components of the electronic printer mechanism 10 are disposed. The upper housing section 22 may be readily disconnected from the lower housing section 23 to expose the printer components for maintenance and repair by slightly flexing each of the two lug members 26, 26 in a direction toward the opposite end wall of the sectional housing and then lifting up on the upper housing section 22 to enable the lug members 26, 26 of the upper housing section 22 to clear the slots 30, 30 provided in the lower housing section 23. Such an arrangement of the sectional housing comprising the upper and lower housing sections 22, 23 enables the electronic printer components to be simply dropped in place with respect to the lower housing section 23, thereby achieving a drop-in assembly of the electronic printer components with respect to the lower housing section 23 prior to releasably securing the upper and lower housing sections 22, 23 together in the manner previously described. To this end, the opposite side walls of the lower housing section 23 as arranged in spaced parallel relationship are respectively provided with complementary sets of shaft-receiving recesses or grooves to facilitate the drop-in assembly of printer components. Thus, as best shown in FIG. 5, the lower housing section 23 is provided with complementary sets of shaft-receiving recesses or grooves 31, 32, and 33, along with a single shaft-receiving recess or groove 34 as will be subsequently described.

Referring now to the components of the electronic printer mechanism 10, a rotatable elongated cylindrical operating shaft 40 (FIGS. 3, 4 and 5) is mounted in the sectional housing so as to extend transversely across the lower housing section 23, the operating shaft 40 having shaft bearing portions 41 of reduced diameter at the opposite ends thereof for bearing support within one set 31 of complementary grooves provided in the side walls of the lower housing section 23. The operating shaft 40 is further provided with a continuous helical groove 42 which is spirally arranged so as to extend from one end of the operating shaft 40 to the other end in a forward direction (i.e., from left-to-right as viewed in FIGS. 3–5) and then turns upon itself in a reversing spiral in a rearward direction along the operating shaft 40 (i.e., from right-to-left as viewed in FIGS. 3–5). The helical groove 42 serves as a sinuous track extending in a forward and a rearward direction along the operating shaft 40 in providing the means for a complete travel cycle of a printhead assembly 43 as mounted on the operating shaft 40 for traversing movement therealong when the operating shaft 40 is undergoing rotation. The helical groove 42 is so structured as to enable the printhead assembly 43 to assume a traversing movement along the rotating operating shaft 40 axially with respect thereto which is approximately 25% faster on the "return stroke" (i.e., axial movement of the printhead assembly 43 in a rearward direction along the rotating operating shaft 40) as compared to the speed of the printhead assembly 43 on the "print stroke" in a forward axial direction along the rotating operating shaft 40.

The printhead assembly 43 comprises a carrier member 44 mounted on the operating shaft 40 for traversing movement therealong to which a printhead 45 is fixedly secured. The printhead 45 may be readily removed from the carrier member 44 for repair and/or replacement. To this end, the printhead 45 is releasably secured to the carrier member 44 by a flexible L-shaped strap 46 (FIG. 8) provided with a suitable opening or aperture in each of the legs thereof for reception of integral ribs or projections on the carrier member 44. The L-shaped flexible strap 46 is initially positioned to bring the aperture in one of the legs thereof into registration with the projection 47 on the carrier member 44. The projection 47 is received by the aperture in the leg of the strap 46 which is then snapped into place such that the aperture thereof on the remaining leg is matched up with the projection 48 on the underlying surface of the printhead. The L-shaped flexible strap 46 further includes a pair of raised bumps 49 extending outwardly of the leg thereof disposed rearwardly of the carrier member 44 and adapted to serve as bearing points against an internal wall of the housing structure.

In a preferred embodiment of the electronic printer mechanism 10, the printhead 45 is a thermal printhead which may be either of the semiconductor mesa matrix type or a thin film type. By way of a specific example, the thermal printhead may comprise a matrix of semiconductor mesas adapted to be selectively actuated, such as described in the aforementioned U.S. Pat. No. 3,874,493 Boyd. However, it will be understood that the printhead 45 may be of a suitable type other than a thermal printhead, wherein the printhead 45 is capable of selectively printing a line of indicia which may include alphanumeric characters and symbols onto a suitable web medium, such as paper, disposed in opposed relation to the printhead 45. The carrier member 44 of the printhead assembly 43 has a follower detent 51 (FIG. 8) mounted in a bore 52 provided therein, the follower detent 51 extending outwardly of the bore 52 and being received by the helical groove 42 of the operating shaft 40. The follower detent 51 comprises a cylindrical pin whose end received within the helical groove 42 of the operating shaft 40 is tapered so as to form a blade 53. The bladed end 53 of the follower detent 51 substantially reduces the extent of frictional engagement between the follower detent 51 and the bottom wall of the helical groove 42 in the operating shaft 40 to minimize the possibility of binding of the follower detent 51 within the helical groove 42 as it tracks therealong when the operating shaft 40 is rotating. In this respect, the rotation of the operating shaft 40 causes the printhead assembly 43 to be moved in an axial traversing movement along the operating shaft 40 as the follower detent 51 of the carrier member 44 follows the track provided by the helical groove 42 in the rotating operating shaft 40.

Figure 8:
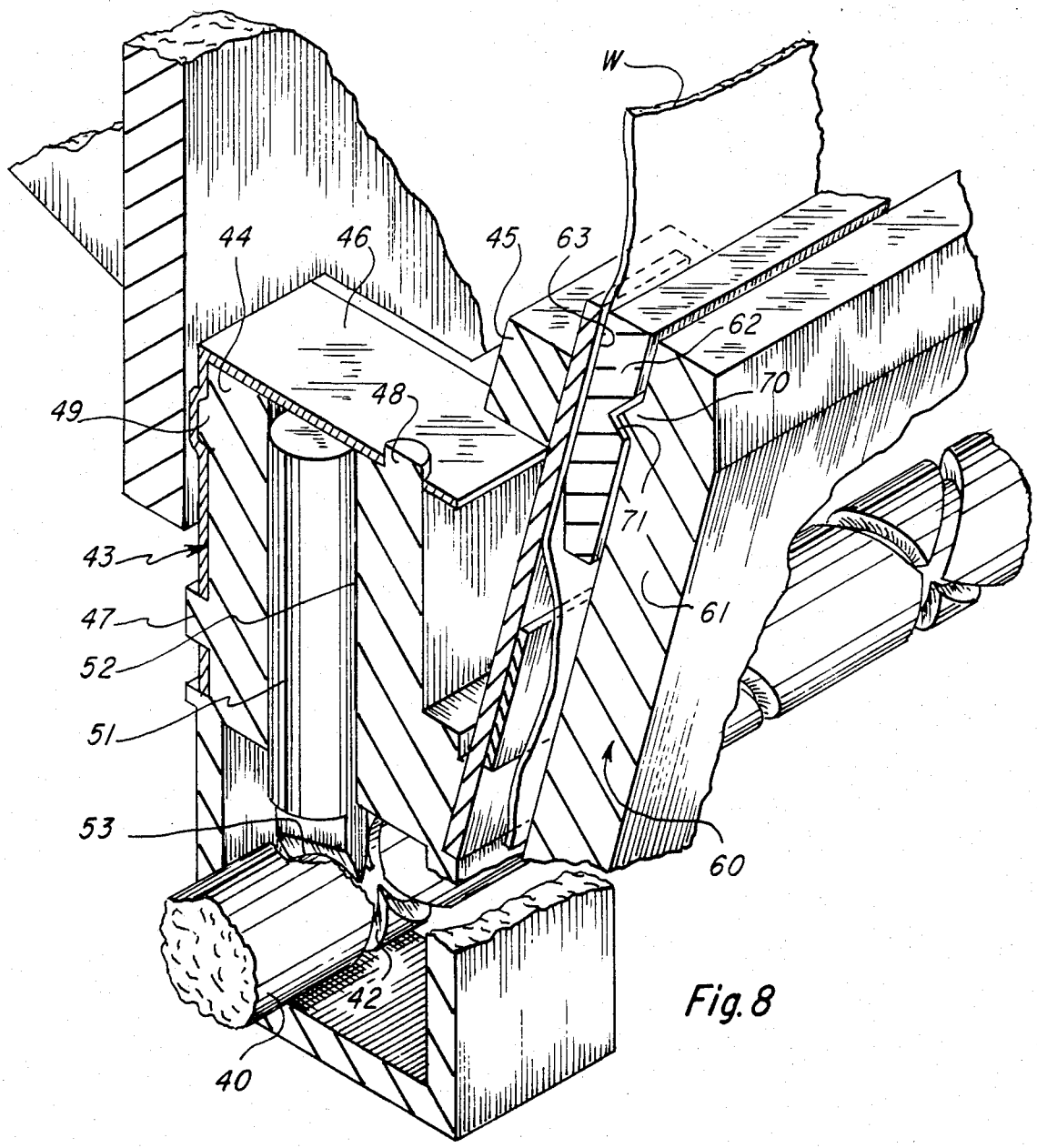
FIG. 8 is a sectional view taken along the line 8—8 of FIG. 2, showing the printhead assembly in opposing relation to the platen member of the electronic printer mechanism.
Figure 9:
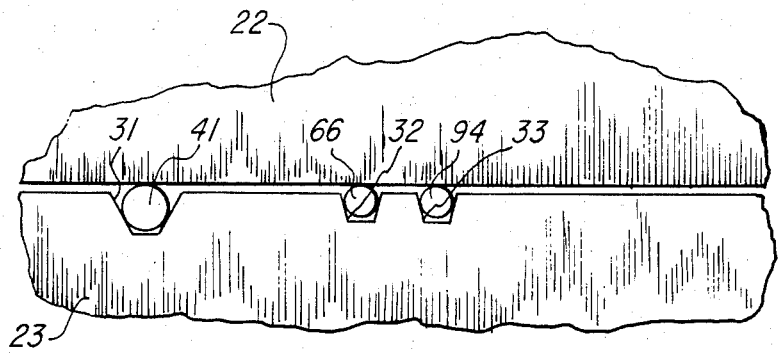
FIG. 9 is a diagrammatic sectional view showing the operating shaft, the shaft supporting the platen member and the web-advancing shaft as mounted within the lower housing section of the electronic printer mechanism.

The thermal printhead 45 of the printhead assembly 43 is adapted to selectively print indicia in the form of alphanumeric characters and symbols onto a web medium W (FIG. 8), such as paper, which is interposed between the printhead 45 and a web-supporting platen member 60. Where the printhead 45 is of the thermal printhead type, the web medium W may be a suitable thermally-sensitive paper. In instances where the printhead 45 is of a type other than a thermal printhead, the web medium W may be of any paper suitable for accepting printed characters thereon. The platen member 60 in the preferred illustrated embodiment is basically a two-part structure, comprising a platen carriage element 61 and a platen bar 62 supported by the platen carriage element 61 and presenting a substantially planar web-supporting surface 63 in opposed relation to the printhead 45, with the web medium W interposed therebetween. The platen carriage element 61 of the composite platen member 60 as best shown in FIG. 5 is generally in the form of a yoke having an elongated body portion 64 extending transversely in substantially parallel relationship and coextensive with the operating shaft 40. The elongated body portion 64 of the platen carriage element 61 has a pair of integral legs 65, 65 depending from the opposite ends thereof and concluding in axial stub shafts 66, 66 for reception within the set of complementary grooves 32, 32 provided in the side walls of the lower housing section 23, such that the platen member 60 is mounted for pivoting movement about the axis of the stub shafts 66, 66 of the platen carriage element 61. The platen carriage element 61 further includes a web guide member 67 which is mounted between the legs 65, 65 of the yoke portion of the platen carriage element 61 so as to extend substantially coextensively with the elongated base portion 64 thereof. The web guide member 67 is pivotally affixed to the respective legs 65, 65 of the platen carriage element 61 at its opposite ends so as to enable the web medium W to be disposed between the elongated base portion 64 of the platen carriage element 61 and the guide member 67 in the space provided therebetween by appropriate pivotal movement of the guide member 67 in a direction away from the elongated base portion 64 of the platen carriage element 61. The platen carriage element 61 is further provided with a pointed bearing support 70 for the platen bar 62, the pointed bearing support 70 being located on the surface of the platen carriage element 61 facing the platen bar 62 and being disposed near the top thereof. As best shown in FIG. 8, the pointed bearing support 70 on the platen carriage element 61 has a cross-section of generally triangular shape, being received within a corresponding elongated wedge-shaped slot or groove 71 formed in the rear surface of the platen bar 62.

The platen bar 62 comprises an elongated strip generally coextensive in length with the elongated base portion 64 of the platen carriage element 61 and supported along its length by the elongated point-shaped bearing 70 of the platen carriage element 61 as partially received within the wedge-shaped elongated notch 71 of the platen bar 62. As shown in FIG. 8, the width dimension of the wedge-shaped elongated notch 71 provided in the rear surface of the platen bar 62 is wider than the tapered point bearing 70 of the platen carriage element 61 which is partially received therein. The platen bar 62 is thereby enabled to pivot about the point of the bearing support 70 on the platen carriage element 61 to a limited extent in either a clockwise or counterclockwise direction such that the web-supporting planar surface 63 thereof may appropriately align itself in opposing relation to the printhead 45 in supporting the web medium W interposed between the printhead 45 and the platen bar 62 of the composite platen member 60. The platen carriage element 61 has a pair of retainer members 72, 72 in the form of perpendicular flanges integral therewith and disposed in spaced relation along the top thereof. The retainer members 72, 72 extend above the platen bar 62 and serve as stops to prevent the platen bar 62 from being moved above the platen carriage element 61.

The composite platen member 60 is resiliently biased in a pivoting direction about the stub shafts 66, 66 of the platen carriage element 61 as received within the set of grooves 32, 32 provided in the side walls of the lower housing section 23 toward the printhead assembly 43 by a suitable biasing means which may take the form of a leaf spring 73 clipped onto the back wall of the upper housing section 22 (FIGS. 3–4) and having a resilient spring finger in biasing engagement with the back surface of the platen carriage element 61 of the platen member 60. Thus, it will be seen that the web medium W interposed between the printhead 45 of the printhead assembly 43 and the elongated platen bar 62 of the platen member 60 is loosely clamped therebetween by the biasing action of the leaf spring 73 on the platen member 60.

The electronic printer mechanism 10 further includes drive means for imparting rotation to the operating shaft 40 in order to achieve traversing movement of the printhead assembly 43 axially along the rotating operating shaft 40 in a forward "print" stroke and a rearward "return" stroke during the printing of one line of indicia. To this end, an electric DC motor 74 is mounted within the lower housing section 23, the motor 74 being provided with a power shaft 75 extending outwardly from one end of the motor housing (FIG. 5). The power shaft 75 extends outwardly of the sectional housing, being received through the groove 34 in one sidewall of the lower housing section 23. The motor 74 may be any suitable DC motor, such as motor No. RF 260-P as manufactured by Mabuchi Motor America Corp. of New York, N.Y.

The drive means further includes a gear train assembly 76 operably associated with the power shaft 75 of the motor 74. The gear train assembly 76 includes a reducer gear cluster associated with the power shaft 75 of the motor 74 and an operating cycle gear cluster associated with the operating shaft 40. Referring to the reducer gear cluster associated with the power shaft 75, there is included a drive gear 77 fixed to the end of the power shaft 75 for rotation therewith and an idler reducer gear including a cogwheel 80 of relatively large diameter and a reducer gear 81 of smaller diameter relative to the cogwheel 80 and integral therewith. The idler reducer gear comprising the cogwheel 80 and the reducer gear 81 is loosely received on the power shaft 75 at an intermediate portion thereon inwardly of the drive gear 77. The drive gear 77 is provided with an annular collar or shoulder 82 thereon of enlarged diameter to maintain a space between the splines or teeth thereof and the cogwheel 80 of the idler reduced gear, but whose primary purpose is to retain the gear train assembly 76 in place as will be subsequently described.

The operating cycle gear cluster operably associated with the operating shaft 40 includes first and second driven gears 83, 84 fixedly mounted on one end of the operating shaft 40 for rotating movement therewith. The first driven gear 83 of relatively large diameter is disposed in meshing engagement with the drive gear 77, while the second driven gear 84 of smaller diameter in relation to the first driven gear 83 is in meshing engagement with the cogwheel 80 of the idler reducer gear comprising the cogwheel 80 and the reducer gear 81 of smaller diameter. Upon being driven by the drive gear 77, the first driven gear 83 imparts rotation to the operating shaft 40, and in being rotated causes the second driven gear 84 to be likewise rotated for driving the cogwheel 80 and its integral reducer gear 81 comprising the idler reducer gear. The operating cycle gear cluster further includes a composite control gear means loosely mounted on the operating shaft 40 inside of the first and second driven gears 83 and 84. The control gear means includes a gear wheel 85 having a plurality of teeth on its outer periphery and a timing control gear wheel 86 fixedly secured to one side surface of the gear wheel 85 for rotary movement therewith. The gear wheel 85 of the control gear means has a cam crank arrangement disposed on the opposite side thereof from the timing gear wheel 86 which will be described hereinafter. The gear wheel 85 of the control gear means is disposed in meshing engagement with the reducer gear 81 of smaller diameter so as to be driven thereby.

In the latter respect, the gear wheel 85 is provided with a plurality of teeth on its outer periphery of a number xN, where x is an integer multiple of the number of teeth or splines N on the outer periphery of the reducer gear 81. Thus, rotation of the reducer gear 81 drives a gear wheel 85 at a speed of rotation 1/x of the rotary speed of the reducer gear 81. By way of example, the speed of rotation of the composite control gear means as determined by the gear wheel 85 may be ⅓rd of the speed of rotation of the reducer gear 81. The gear train assembly 76 is so structured that each of the small diameter gears 77, 81 and 84 included therein is of the same diameter and has the same number of teeth on its outer periphery. Similarly, each of the large diameter gears 80, 83 and 85 is of the same diameter and has the same number of teeth on its outer periphery. Thus, the small diameter gears 77, 81 and 84 reduce the speed of rotation of the corresponding large diameter gears in meshing engagement therewith by ⅓rd in the manner previously described in connection with the speed reduction ratio between the reducer gear 81 and the gear wheel 85. In this connection, the drive gear 77 reduces the speed of rotation of the first driven gear 83 to ⅓rd that of the power shaft 75; the second driven gear 84 reduces the speed of rotation of the cogwheel 80 to ⅓rd that of the second driven gear 84 or 1/9th that of the power shaft 75; and the reducer gear 81 reduces the speed of rotation of the gear wheel 85 to ⅓rd that of the reducer gear 81 or 1/27th that of the power shaft 75.

Only the outermost gear component of the gear train assembly 76 is fixedly secured by a press fit or other suitable means to the shaft on which it is mounted. Thus, the first driven gear 83 and the second driven gear 84 movable therewith are fixedly mounted on one end of the operating shaft 40 by a press fit for rotating movement therewith. The outermost gear of the gear train assembly 76, the first driven gear 83, maintains the remainder of the gear train assembly 76 in place. In this respect, the annular collar 82 of the drive gear 77 is located behind the first driven gear 83 and prevents the drive gear 77 from sliding off of the power shaft 75, thereby retaining the drive gear 77, the cogwheel 80 and the reducer gear 81 on the power shaft 75. The drive gear 77 itself although constrained to rotate with the power shaft 75 is slidably mounted thereon, the power shaft 75 and the drive gear 77 being provided with mating flat surfaces or similar means so that the drive gear 77 is rotated with the power shaft 75. Thus, it will be understood that the complete gear train assembly 76 may be readily disassembled by removing the first driven gear 83 (and the second driven gear 84 integral therewith) from the operating shaft 40, whereupon the remaining gears of the gear train assembly 76 may be simply slid off the respective shafts on which they are mounted.

Figure 10:
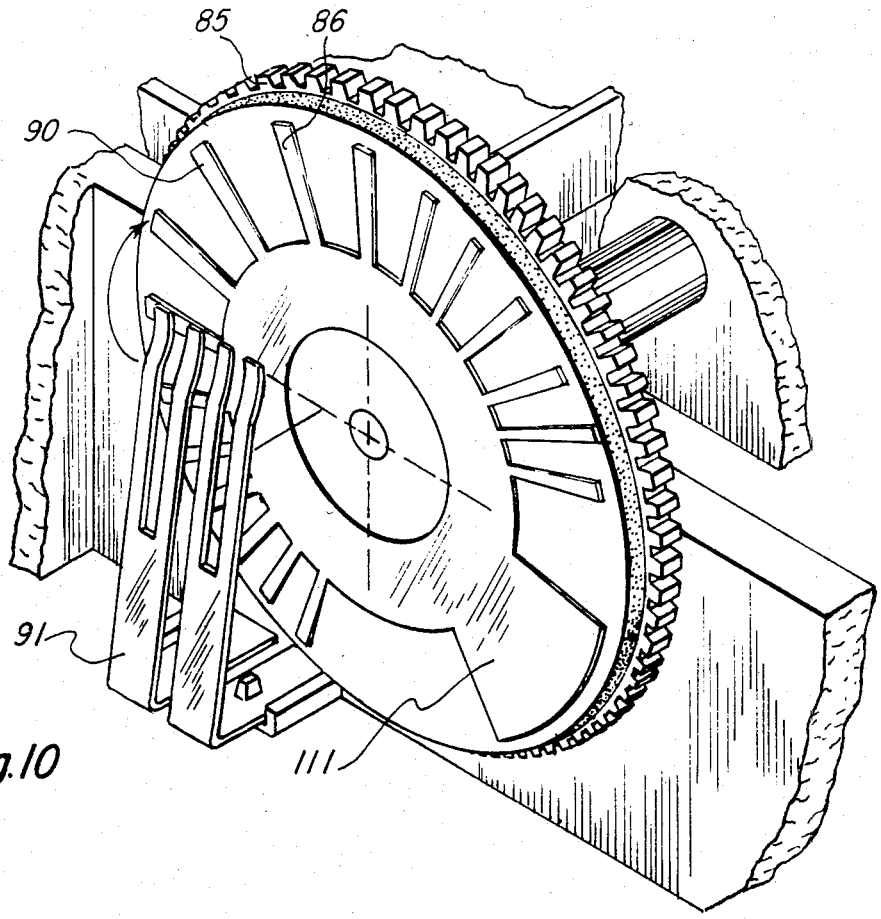
FIG. 10 is an enlarged perspective view of a timing control gear included in the gear train of the electronic printer mechanism and having a timing control strip pattern in operable relationship with an electrical contact member.

The timing gear wheel 86 affixed to one side of the gear wheel 85 is provided with a pattern of conductive timing strips 90 on the side surface thereof opposite from the gear wheel 85. The pattern of conductive timing strips 90 defines a timing control and is generally annularly arranged to present a plurality of radially extending conductive timing strips adapted to be sequentially engaged by an electrical contact member 91 FIGS. 5 and 10). Thus, the pattern of conductive timing strips 90 on the timing control gear wheel 86 comprises a commutator disc, and the electrical contact member 91 comprises brushes of electrically conductive material adapted to be resiliently flexed in engagement with successive timing strips on the commutator disc 90. The electrical contact member 91 comprises a pair of bifurcated wiper brushes of electrically conductive material, the electrical contact member 91 being mounted on a side wall of the lower housing section 23 so as to dispose the flexible wiper brushes thereof in flexible engagement with the side surface of the timing gear wheel 86 on which the commutator disc 90 is disposed (FIG. 10).

The electronic printer mechanism 10 is further provided with a web-advancing means for advancing the web medium W as interposed between the printhead 45 and the platen bar 62 one line at a time in response to completion of the printing of one line of indicia by the printhead 45. To this end, the side surface of the gear wheel 85 opposite from the commutator disc 90 is provided with a cam crank arrangement 92 for cooperation with a web-advancing gear wheel 93 fixedly secured to one end of a web-advancing shaft 94. The web-advancing shaft 94 is provided with a pair of rollers 95, 95 which may be of rubber or other suitable frictional material for engagement with the web medium W. The rollers 95, 95 are pressed onto the web-advancing shaft 94 from the end thereof opposite from the web-advancing gear wheel 93, with the rollers 95, 95 being adapted to be frictionally held by the web-advancing shaft 94 but subject to sliding movement therealong for adjustment upon the application of sufficient pressure thereto. The web-advancing gear wheel 93 is in the form of a so-called Geneva gear wheel, as shown in enlarged form in FIG. 6*a*.

Figure 7:
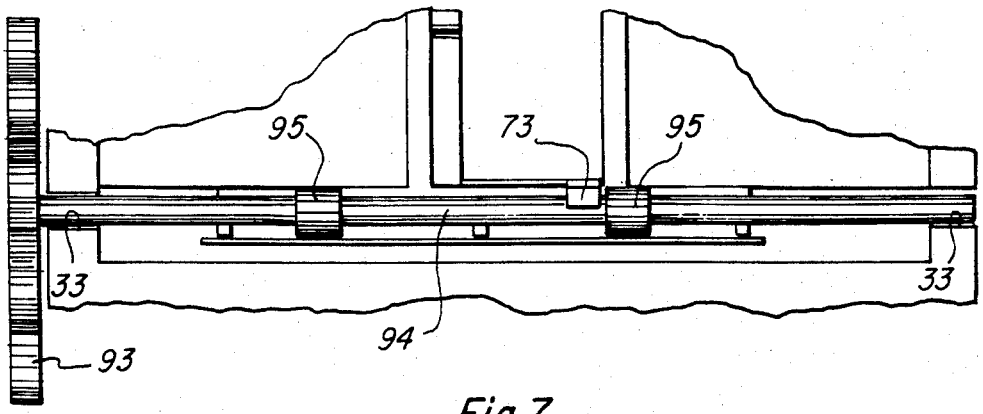
FIG. 7 is a partially diagrammatic transverse sectional view showing the shaft of the web-advancing assembly with the Geneva gear wheel affixed to one end thereof as mounted within the housing of the electronic printer mechanism.

The web-advancing shaft 94 is mounted on the lower housing section 23 so as to extend transversely thereacross, with the end thereof opposite from the Geneva gear wheel 93 being adapted to be received within the groove 33 provided in one side wall of the lower housing section 23 in freely floating relationship with respect thereto (FIG. 7). The opposite end portion of the shaft 94 adjacent to the Geneva gear wheel 93 is received within the corresponding groove 33 in the opposite side wall of the lower housing section 23, being supported by the side walls of the groove 33 which serve as bearing surfaces for the web-advancing shaft 94 in conjunction with the pair of rollers 95, 95 as frictionally mounted on the shaft 94, the rollers 95, 95 laying upon a flat surface of a web supply chute 96. The web supply chute 96 is an integral portion of the lower housing section 23 and is located immediately behind the platen carriage element 61 and the web guide member 67 pivotally mounted thereon. The web supply chute 96 is provided with an upstanding transversely elongated web guide support 97 at the end thereof adjacent the platen carriage element 61 and the pivotally mounted guide member 67 thereon. The elongated web guide support 97 of the web supply chute 96 is provided with a beveled surface facing the guide member 67 mounted on the platen carriage element 61. Together, the web guide member 67 and the web guide support 97 of the web supply chute 96 cooperate in maintaining the web medium W in an aligned path extending through the platen carriage element 61 just above the web guide member 67 pivotally mounted thereon, the web medium W thereafter being fed between the platen bar 62 and the printhead 45, as previously described. The Geneva gear wheel 93 of the web-advancing mechanism is located just beyond the side wall of the lower housing section 23 in which the groove 33 is formed for providing bearing surfaces to the end portion of the web-advancing shaft 94 received thereby (FIG. 2). Biasing means in the form of the leaf spring 73 exerts a resilient biasing force on the web-advancing assembly via a leaf spring finger of the leaf spring 73 in flexed engagement with the shaft 94 (FIG. 7) of the web-advancing assembly. Thus, it will be observed that the web-advancing assembly includes a shaft 94 which is constrained to rotation at the end thereof adjacent the Geneva gear wheel 93 by virtue of the bearing surfaces provided by the groove 33 in the lower housing section 23 on which the shaft 94 rests in cooperation with the mating side wall of the upper housing section 22. Conversely, at the opposite end of the shaft 94, a vertically floating relationship exists between the shaft end and the mating side wall portions of the upper and lower housing sections 22, 23, with this end of the shaft 94 being received in the groove 34 of the lower housing section 23, and constrained by the side walls thereof to vertical movement only. This arrangement enables the web medium W to be pulled through between the rollers 95, 95 on the web-advancing shaft 94 and the web supply chute 96 and permits relatively large tolerances for proper functioning without requiring a separate mechanical mechanism for this purpose.

Figure 6A:
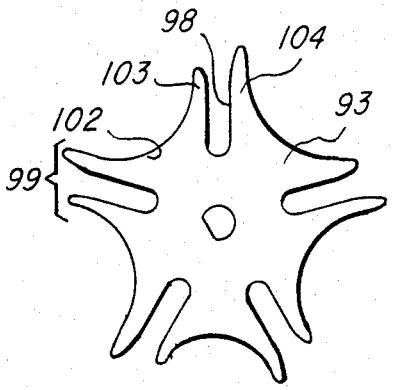
FIG. 6*a* is an elevational view of a Geneva gear wheel employed in the web-advancing assembly for the electronic printer mechanism.

The Geneva gear wheel 93 is illustrated in FIG. 6*a* and may be described as a cam-like mechanism taking on the general form of a Maltese cross which it is sometimes called. As illustrated, the gear wheel 93 is a five-slot Geneva gear wheel, wherein individual slots 98 are associated with respective lobe portions 99 extending radially outwardly from the center of the Geneva gear wheel 93. Each lobe portion 99 is provided with a corresponding slot 98 so as to define respective tines 103, 104 of the individual lobe portions 99. I have determined that the Geneva geaar wheel 93 in its operative relationship with the cam crank arrangement 92 is made substantially free from jamming by constructing the Geneva gear wheel 93 as an asymmetric element. In this respect, I have determined that the respective tines 103, 104 of the lobe portions 99 of the Geneva gear wheel 93 should be formed so as to be of unequal radial extent, wherein the tine 104 is of increased radial extent with respect to the tine 103. The periphery of the Geneva gear wheel 93 is completed by respective arcuate recesses 102 disposed between successive lobe portions 99.

The web-advancing assembly further includes the cam crank arrangement 92 disposed on the opposite side surface of the gear wheel 85 from the commutator disc 90 which comprises the timing control. The cam crank arrangement 92 comprises a pair of projections extending outwardly from the opposite side surface of the gear wheel 85, the pair of projections including an arcuate restraining member 100 and a peg 101 (FIGS. 5 and 6*b*–6*d*). The arcuate restraining member 100 of the cam crank arrangement 92 is disposed radially outwardly with respect to the central axis of the gear wheel 85, extending partially therearound and being open-ended. The peg 101 of the cam crank arrangement 92 is located in registration with the opening in the arcuate restraining member 100 so as to be centrally disposed with respect to the spaced ends of the arcuate restraining member 100 and radially outwardly thereof.

Figure 6C:
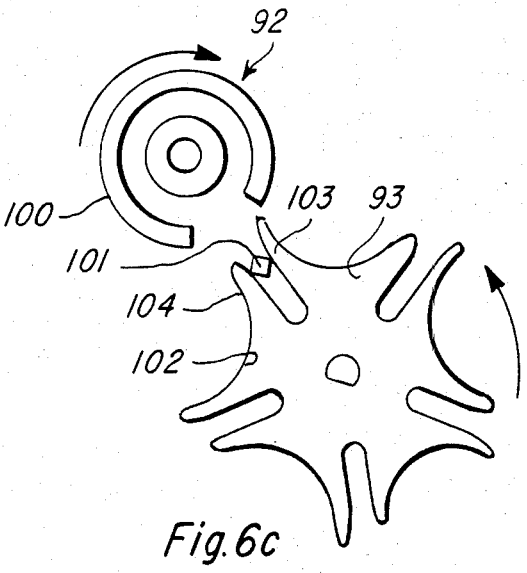
FIGS. 6*b*–6*d* are diagrammatic elevational views showing the sequential movement of an interacting cam crank arrangement with the Geneva gear wheel of FIG. 6*a* in effecting a web advance of one line in the electronic printer mechanism.
Figure 6B:
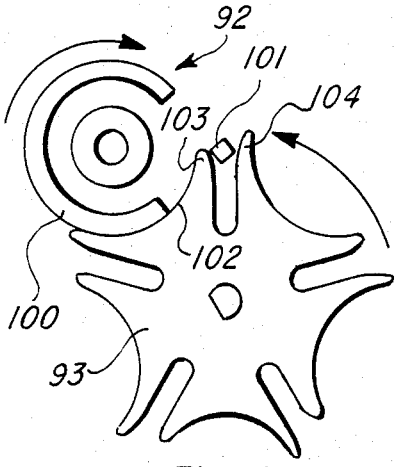
Figure 6D:
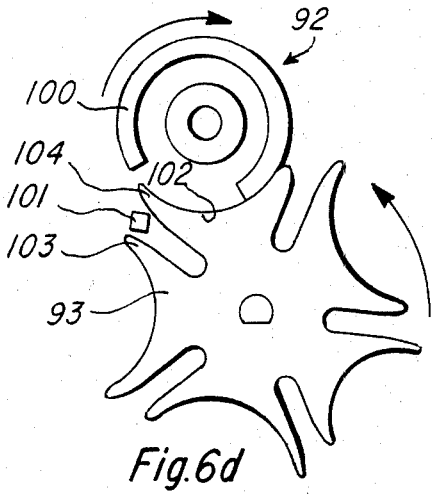

Referring specifically to FIGS. 6*b*–6*d*, sequential operation of the caam crank arrangement 92 formed on the side surface of the gear wheel 85 and the Geneva gear wheel 93 fixedly mounted on the web-advancing shaft 94 is diagrammatically illustrated through one operating cycle of the web-advancing assembly in advancing the web medium W one line between the printhead 45 and the platen bar 62. In this connection, the cam crank arrangement 92 is in meshing engagement with the Geneva gear wheel 93 and upon being rotated through one complete revolution causes the Geneva gear wheel 93 to be advanced one sequence, thereby rotating the web-advancing shaft 94 through a limited arc to feed the web medium W a one line increment between the printhead 45 and the platen bar 62. In FIG. 6*b*, the cam crank arrangement 92 is shown as being rotated in a clockwise direction, the arcuate restraining member 100 thereof being disposed in a complementary arcuately shaped recess 102 of the Geneva gear wheel configuration. The peg 101 of the cam crank arrangement 92 is received between two tines 103, 104 of the Geneva gear wheel 93, the tine 104 being of increased radial extent with respect to the tine 103. The longer tine 104 is the leading tine first encountered by the arcuate restraining member 100, and the shorter tine 103 is the trailing tine. This relationship avoids jamming between the Geneva gear wheel 93 and the cam crank arrangement 92. The Geneva gear wheel 93 under the driving influence of the cam crank arrangement 92 in the sequence illustrated in FIG. 6*b* is rotated in a counterclockwise direction, or in the opposite direction of rotation to that of the cam crank arrangement 92. As shown in FIG. 6*c*, continued clockwise rotation of the cam crank arrangement 92 drives the Geneva gear wheel 93 in a counterclockwise direction, with the arcuate restraining member 100 of the cam crank arrangement 92 leaving the arcuate recess 102 of the Geneva gear wheel 93 and assuming a position, wherein its open end is in registration with the tines 103, 104 of the Geneva gear wheel 93. The peg 101 of the cam crank arrangement 92 remains in the space between the tines 103, 104 of the Geneva gear wheel 93 in the sequence illustrated in FIG. 6*c*. Thereafter, as illustrated in FIG. 6*d*, continued clockwise rotation of the cam crank arrangement 92 causes the open-ended arcuate restraining member 100 thereof to assume a position within the next successive arcuate recess 102 formed in the Geneva gear wheel 93, with the peg 101 still being disposed between the tines 103, 104 of the Geneva gear wheel 93. In this sequence, the Geneva gear wheel 93 is locked in position and cannot rotate. Thus, the web-advancing assembly intermittently feeds the web medium W between the printhead 45 and the platen bar 62 in one line increments for each rotation sequence of the Geneva gear wheel 93, as illustrated in FIGS. 6*b*–6*d*.

Where the printhead 45 is a thermal printhead of the type having a matrix of semiconductor mesas, for example, as disclosed in the aforementioned U.S. Pat. No. 3,874,493 Boyd, a multilead strap cable 110 is secured to the thermal printhead 45. Each of the semiconductor mesas on the thermal printhead 45 is electrically connected to a respective lead in the multilead strap cable 110 which is electrically connected to the electronic control circuitry 16 (FIG. 2) for enabling selective heating of individual semiconductor mesas of the thermal printhead 45 in producing printed characters on the thermally-sensitive web medium W adjacent thereto. In this connection, FIG. 10 illustrates the timing gear wheel 86 with the commutator disc 90 thereon in operable association with the electrical contact member 91 which comprises a pair of flexible electrically conductive wiper brushes brought into successive engagement with timing strips on the commutator disc 90 by the rotation of the timing gear wheel 86 as the toothed gear wheel 85 of which it is a part is rotated. It will be understood that respective electronic circuits in the electronic control circuitry 16 (FIG. 2) are completed as the wiper brushes of the electrical contact member 91 come into engagement with the individual electrically conductive strips of the commutator disc 90, thereby causing the electronic printer mechanism 10 to be operated through a complete cycle as the timing gear wheel 86 rotates through one full revolution. In this respect, the carrier member 44 of the printhead assembly 43 traverses the length of the rotating operating shaft 40 in both a forward and a reverse direction for each complete revolution of the timing gear wheel 86 in accomplishing an operating cycle of the electronic printer mechanism 10. The commutator disc 90 of the timing gear wheel 86 is further provided with a radial timing strip 111 of substantially increased width with respect to the remainder of the timing strips, the increased width radial timing strip 11 being the "home" position for the wiper brushes of the electrical contact member 91 where the timing gear wheel 86 automatically stops when no new information is to be printed by the electronic printer mechanism 10.

By way of example, the electronic printer mechanism 10 may be constructed with a sectional housing of a suitable molded plastic material, such as ABS plastic (i.e., acrylonitrile butadiene styrene) which is 30% glass-filled for avoiding any tendency of the plastic material toward creeping when the electronic printer mechanism 10 has been in use for an extended time period. The platen member 60 may likewise have its component parts molded of a suitable plastic material. Thus, the platen carriage element 61, being somewhat thicker than the upper and lower housing sections 22, 23 could be formed of ABS plastic material without any glass filling. The platen bar 62 which is subjected to heat where the printhead 45 of the printhead assembly 43 is of the thermal printhead type is preferably molded from a suitable rigid, heat-resistant plastic material, such as "Ryton" TM, a polyphenylene sulfide plastic material available from Phillips Petroleum of Bartlesville, Okla. The individual gear wheels of the gear train assembly 76 may likewise be formed of a suitable plastic material, such as an acetal homopolymer plastic material available as "Delrin" TM from E.I. DuPont de Nemours Inc. of Wilmington, Del. The multilead strap cable 110 interconnecting the individual semiconductor mesas of the thermal printhead 45 to the electronic control circuitry 16 may be a plastic film, such as "Kapton" in which a plurality of electrical leads are encapsulated, the plurality of electrical leads providing an electrical connection to seven vertical resistors of the thermal printhead 45 and adapted to receive appropriate electrical signals for actuating the resistors in providing heat for producing printed characters on thermally-sensitive paper which serves as the web medium W.

The operating shaft 40 as provided with the continuous helical groove 42 may be made from a suitable machinable metal. Specifically, the operating shaft 40 may be of free machining brass as plated with electroless nickel plate. The follower detent 51 which tracks in the helical groove 42 of the operating shaft 40 may likewise be made of a suitable metal. Specifically, the follower detent 51 may be free machining brass, as is the operating shaft 40, but electroplated with sulfamate nickel, thereby providing an electroplated nickel coating thereon. The helical groove-defining wall surfaces of electroless nickel plate as provided by the operating shaft 40 in running engagement against the electroplated sulfamate nickel coating of the follower detent 51 effectively contribute to a minimum of friction, wear and galling between the rubbing surfaces. The leaf spring 73 may be of any suitable material offering flexible resilience, such as a spring metal which may be beryllium copper, for example. The electrical contact member 91 with its flexible wiper brushes may be of similar spring metal material which is electrically conductive, such as beryllium copper, whose contact surfaces are gold-coated to be corrosion-resistant. Likewise, the commutator disc 90 of the timing gear wheel 86 is made of electrically conductive metal as coated with gold.

Thus, it will be seen that an electronic printer mechanism 10 has been disclosed which permits of ready disassembly and re-assembly by virtue of the sectional housing thereof, wherein the lower housing section 23 when disengaged from the upper housing section 22 may accept respective drop-in component assemblies. Furthermore, the electronic printer mechanism 10 is equipped with a web-advancing assembly utilizing a Geneva gear wheel 93 in conjunction with a cam crank arrangememnt 92 in achieving incremental one-line advancement of the web medium between the printhead 45 and the platen bar 62 of the composite platen member 60 offering a wide tolerance in usage by an operator substantially eliminating any jamming tendency on the part of the web-advancing assembly. Still further, the printhead assembly 43 as mounted on the operating shaft 40 for traversing movement therealong in response to rotation of the operating shaft 40 by virtue of the track provided by the helical groove 42 in the operating shaft 40 and the follower detent 51 of the printhead assembly 43 as received in the helical groove 42 provides enhanced reliability in the traversing movement of the printhead assembly 43, wherein the printhead assembly 43 has a travel time on its "return stroke" which is 25% less than the travel time on its "print stroke", thereby reducing the total cycle time of the electronic printer mechanism 10.

Although a preferred embodiment of the invention has been described in detail, it is to be understood that various changes, substitutions, and alterations can be made therein without departing from the spirit and scope of the invention as defined by the appended claims.

What is claimed is:

1. A printer mechanism comprising:

a housing;

a rotatable operating shaft mounted in said housing;

a carrier member mounted on said operating shaft for traversing movement therealong;

a printhead fixedly supported by said carrier member for traversing movement therewith in relation to said operating shaft and adapted to selectively produce indicia including alphanumeric characters and symbols for printing onto a web medium disposed in opposed relation to said printhead;

a platen member disposed above said operating shaft and extending across said housing in parallel offset relation to said operating shaft, said platen member having a web-supporting planar surface facing said printhead;

means biasing said platen member in a direction toward said printhead such that the web medium extending between said printhead and said platen member is loosely clamped therebetween;

a motor having a rotatable power shaft;

gear train means operably associated with said power shaft and said operating shaft to impart rotation to said operating shaft upon the rotation of said power shaft, said gear train means comprising a drive gear fixed to said power shaft and rotating therewith, an idler reducer gear having a cogwheel of larger diameter with respect thereto and movable therewith loosely mounted on said power shaft, a first driven gear fixedly mounted on said operating shaft, a second driven gear of smaller diameter than said first driven gear, said second driven gear being fixedly mounted on said operating shaft and being movable with said first driven gear, control gear means loosely mounted on said operating shaft, said control gear means comprising a toothed gear wheel having a plurality of teeth on its outer periphery of a number xN, where x is an integer multiple of the number of teeth N on the outer periphery of said reducer gear, said toothed gear wheel of said control gear means having a pattern of conductive timing strips disposed on one side surface thereof to define a timing control and having cam means disposed on the opposite side surface thereof, said drive gear being in meshing engagement with said first driven gear to impart rotation thereto via the rotation of said power shaft for rotating said second driven gear and said operating shaft, said second driven gear being in meshing engagement with said cogwheel of said idler reducer gear to impart rotation thereto when said second driven gear is undergoing rotation, said reducer gear being in meshing engagement with said toothed gear wheel of said control gear means to impart rotation thereto when said reducer gear is undergoing rotation such that said control gear means is rotated at a speed 1/x of the rotary speed of said reducer gear, timing control means including an electrical contact member in engagement with one of said conductive timing strips of said pattern thereof disposed on said one side surface of said toothed gear wheel for regulating the operating cycle of said printer mechanism in response to rotation of said control gear means disposing successive conductive timing strips in respective engagement with said electrical contact member in producing respective lines of printed type on the web medium, and means operably associated with said cam means disposed on the opposite side surface of said toothed gear wheel of said control gear means for advancing the web medium one line at a time in response to completion of one line of printed type by said printhead; and means actuating said motor to rotate said power shaft; and said carrier member moving axially along said operating shaft in response to the rotation thereof to position said printhead for producing printed indicia along a line of the web medium disposed between said printhead and said platen member.

2. A printer mechanism as set forth in claim 1, wherein said cam means comprises an arcuate open-ended member and a peg disposed radially outwardly of said arcuate member in radial registration with the opening therein, said arcuate member and said peg projecting from said opposite side surface of said toothed gear wheel of said control gear means;

said means operably associated with said cam means for advancing the web medium comprising a web-advancing shaft, a Geneva gear wheel fixedly secured to one end of said web-advancing shaft and disposed in opposition to said cam means; and said Geneva gear wheel being periodically rotated in response to the rotation of said toothed gear wheel of said control gear means by camming engagement with said arcuate member and said peg therewith to intermittently rotate said web-advancing shaft for advancing the web medium a one line increment for each periodic rotation of said Geneva gear wheel.

* * * * *